US009284868B2

(12) United States Patent
Pommerer et al.

(10) Patent No.: US 9,284,868 B2
(45) Date of Patent: Mar. 15, 2016

(54) EXHAUST DEVICE FOR AN INTERNAL COMBUSTION ENGINE

(71) Applicant: Eberspächer Exhaust Technology GmbH & Co. KG, Neunkirchen (DE)

(72) Inventors: Michael Pommerer, Uhingen (DE); Viktor Koch, Göppingen (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 269 days.

(21) Appl. No.: 13/745,166

(22) Filed: Jan. 18, 2013

(65) Prior Publication Data

US 2013/0186062 A1 Jul. 25, 2013

(30) Foreign Application Priority Data

Jan. 19, 2012 (DE) ..... 10 2012 200 712

(51) Int. Cl.

| | |
|---|---|
| ***F02B 27/04*** | (2006.01) |
| ***F01N 1/02*** | (2006.01) |
| ***F01N 1/06*** | (2006.01) |
| ***G10K 15/02*** | (2006.01) |
| *F02M 35/12* | (2006.01) |
| *F02B 75/22* | (2006.01) |

(52) U.S. Cl.

CPC *F01N 1/02* (2013.01); *F01N 1/023* (2013.01); *F01N 1/065* (2013.01); *G10K 15/02* (2013.01); *F01N 2210/02* (2013.01); *F02B 75/22* (2013.01); *F02M 35/125* (2013.01)

(58) Field of Classification Search

CPC ..... G10K 15/02; F01N 1/02; F01N 1/065; F01N 1/023; F02M 35/125

USPC ..... 60/273

See application file for complete search history.

(56) References Cited

U.S. PATENT DOCUMENTS 5,146,505 A * 9/1992 Pfaff et al. ..... 381/71.9
5,222,148 A 6/1993 Yuan (Continued)

FOREIGN PATENT DOCUMENTS

DE 40 24 803 A1 2/1992
DE 69 319 783 T3 11/1998

(Continued)

OTHER PUBLICATIONS

English translation of JP 10143169 (May 1998).*

(Continued)

*Primary Examiner* — Jason Shanske
(74) *Attorney, Agent, or Firm* — McGlew and Tuttle, P.C.

(57) ABSTRACT

An exhaust device (2) for an internal combustion engine (3) has an exhaust line (5) with a rear section X with two exhaust pipes (11) connected to an acoustic actuator (12) in a sound-transmitting manner. Better acoustic characteristics and increased number of noises audible from the outside is guaranteed by the exhaust pipes (11) being of different designs and/or by the actuators (12) being able to be actuated individually. A process for controlling the actuators (12) uses a control device (25) that actuates the actuators (12) individually to generate different acoustic signals (23) of the respective actuators (12). A motor vehicle (1) is provided with such an exhaust device (2) with acoustic actuators (12) controlled by such a process. The motor vehicle (1) has additional actuators (29, 31), which are especially associated with an intake line (30) and are arranged in the interior of motor vehicle (1).

20 Claims, 3 Drawing Sheets

(56) References Cited

U.S. PATENT DOCUMENTS

| | | | | |
|---|---|---|---|---|
| 5,848,168 | A | 12/1998 | Shipps et al. | |
| 6,633,646 | B1 * | 10/2003 | Hwang | G10K 11/175 181/206 |
| 2004/0031258 | A1 * | 2/2004 | Papamoschou | 60/204 |
| 2013/0161124 | A1 * | 6/2013 | Neumann et al. | 181/228 |
| 2014/0376733 | A1 * | 12/2014 | Pommerer et al. | 381/71.4 |

FOREIGN PATENT DOCUMENTS

| | | | | | |
|---|---|---|---|---|---|
| DE | 101 37 239 | A1 | | 2/2002 | |
| DE | 697 23 945 | T2 | | 7/2004 | |
| DE | 100 85 230 | B3 | | 3/2012 | |
| EP | 840285 | A2 | * | 5/1998 | G10K 11/178 |
| EP | 2 138 700 | A2 | | 12/2009 | |
| JP | 06266367 | A | * | 9/1994 | G10K 11/16 |
| JP | 07319481 | A | * | 12/1995 | G10K 11/178 |
| JP | 08123435 | A | * | 5/1996 | G10K 11/178 |
| JP | 10143169 | A | * | 5/1998 | G10K 11/178 |

OTHER PUBLICATIONS

English translation of JP 7319481 (Dec. 1995).*
English translation of JP 08123435 (May 1996).*
English translation of JP 6266367 (Sep. 1994).*

* cited by examiner

EXHAUST DEVICE FOR AN INTERNAL COMBUSTION ENGINE

CROSS REFERENCE TO RELATED APPLICATIONS

This application claims the benefit of priority under 35 U.S.C. §119 of German Patent Application DE 10 2012 200 712.1 filed Jan. 19, 2012, the entire contents of which are incorporated herein by reference.

FIELD OF THE INVENTION

The present invention pertains to an exhaust device for an internal combustion engine, preferably of a motor vehicle, as well as to a process for controlling acoustic actuators of such an exhaust device. In addition, the present invention pertains to a motor vehicle with such an exhaust device.

BACKGROUND OF THE INVENTION

An exhaust device serves primarily the purpose of removing an exhaust gas produced by an internal combustion engine. For this, the exhaust device has an exhaust line, through which the exhaust gas flows. The exhaust device may also be used for acoustic purposes. Thus, exhaust devices often have at least one muffler (also known as a silencer), which is arranged in the exhaust line in order to manipulate and especially filter certain, predetermined ranges of the sound in the exhaust device or of the sound generated by the exhaust device. The exhaust device can usually be connected to the internal combustion engine, especially by means of one or more exhaust manifolds, upstream of the muffler. In a so-called double-flow exhaust device, the exhaust line has, moreover, two exhaust lines, at least in a rear section, which are usually arranged downstream of the muffler. To produce certain acoustic effects, for example, noises matching the particular engine speed or load of the internal combustion engine, acoustic actuators may, furthermore, be provided, wherein the particular exhaust line may have at least one such actuator, which is connected to this exhaust line in a sound-transmitting manner. Such an actuator is especially an electromagnetic sound generator, which forms a loudspeaker together with a membrane, wherein the sound generated by the loudspeaker can be transmitted to the particular exhaust line or to the exhaust gas. The interaction of the sound generated by one exhaust line with the sound generated by the other exhaust line, especially in the rear section, is used to achieve such acoustic effects.

The drawback of this is that the exhaust lines, especially those in the rear section, usually have the same design. In addition, the actuators of the rear exhaust lines usually generate an identical sound signal. This may lead to undesired and unfavorable noises, especially in the remote area, i.e., outside the exhaust device, in case of superposition of the sound waves generated by the exhaust lines. The variety of the noises that can be generated is thus also limited.

SUMMARY OF THE INVENTION

The present invention pertains to an object of providing an improved or at least alternative embodiment, which is characterized especially by an improved acoustic characteristic as well as an improvement of the variety of the noises or acoustic effects that can be produced with the exhaust device, for an exhaust device for an internal combustion engine, preferably of a motor vehicle, as well as for a process for operating such an exhaust device.

According to the invention, an exhaust device is provided for an internal combustion engine with an exhaust line which has a double-flow section at least in a rear section. The exhaust device comprises a first exhaust pipe in the double-flow section, a second exhaust pipe in the double-flow section, a first acoustic actuator connected to the first exhaust pipe in a sound-transmitting manner and a second acoustic actuator connected to the first exhaust pipe in a sound-transmitting manner. The exhaust pipes have different designs or the first and second acoustic actuators are actuated individually. A control device (electronic control unit) may be provided for individually actuating the first acoustic actuator and the second acoustic actuator.

The present invention is based on the general idea of designing the particular exhaust line and of equipping the exhaust device in an exhaust device, which has, at least in a rear section, two exhaust lines, which have at least one acoustic actuator each, such that the exhaust lines generate and/or emit different or individual sound waves. It is thus possible, in particular, to obtain an increased variety of the acoustic effects generated due to the superposition of these sound waves, especially in the remote area and outside the exhaust device. Thus, desired acoustic noises can be generated or emphasized, especially by constructive and destructive interference, while undesired noises are suppressed or reduced.

According to a first solution according to the present invention, this can take place by means of a different design of an exhaust line of the exhaust device, especially in the rear section. The sound waves emitted by the respective exhaust line are thus different, especially also when the respective actuators have identical design and/or generate the same acoustic signals. Such a different design of the exhaust lines is embodied, for example, when the exhaust lines have an asymmetrical design or the actuators are arranged asymmetrically. An asymmetrical design is given, e.g., when the sound superposition of the acoustic signals generated by the actuators takes place at different points of the respective exhaust lines.

The terms "in the rear" as well as "rear" are related here especially to the direction of flow of the exhaust gas flowing in the exhaust line on the discharge side and to the remote arrangement in relation to an internal combustion engine, with which the exhaust line can be connected in an exhaust gas-carrying manner. The exhaust line correspondingly has, at least in this rear section, two exhaust lines, which will hereinafter be called rear exhaust lines, wherein the rear exhaust lines may be characterized especially in that they are arranged on the downstream side at an outlet of the exhaust device or have such an outlet. The exhaust line consequently has a double-flow design in the rear area.

According to a second solution, the respective actuators may be designed or equipped such that they can simultaneously generate different acoustic signals. An embodiment in which the actuators of the different rear exhaust lines can be actuated or are actuated individually is preferred here. The actuation of the actuators is preferably carried out by a control means (control device). The control device is designed in this case such that it individually actuates the respective rear exhaust lines, wherein the actuation is carried out by means of sending a corresponding control signal or control signals. Individually actuatable means in this case that the respective actuators can be actuated or are actuated such that these can generate the same acoustic signal and/or different acoustic signals. A plurality of acoustic effects or noises can be generated by the individual actuation of the respective actuator, especially in the remote area, even if the respective actuators have the same design and/or if the rear exhaust lines have the same design. In particular, the rear exhaust lines including the actuators may be designed as identical parts.

It is apparent that the first solution according to the present invention and the second solution according to the present invention may be combined with one another as desired. This means, for example, that both the rear exhaust lines may have different designs and the actuators may also be able to be actuated, especially by means of the control device, such that they simultaneously generate different acoustic signals.

Such an exhaust device with the two rear exhaust lines is usually called a two-stage exhaust device. The exhaust line may have in this case at least one front exhaust line, which can connect the exhaust line to the corresponding internal combustion engine in an exhaust gas-carrying manner, in a front section, i.e., upstream of the rear section. The at least one front exhaust line may be connected to the rear exhaust lines fluidically and/or in a sound-transmitting manner in any desired manner. If the exhaust line has two front exhaust lines, the connection to the rear exhaust lines may be embodied, for example, by means of an X-pipe. If the exhaust line has an individual front exhaust line, this connection may be embodied, for example, by means of a Y-pipe. The front exhaust line consequently splits in the latter possibility into the two rear exhaust lines at the branching of the Y-pipe. Uniform distribution of the exhaust gas into the rear exhaust lines preferably takes place at the transition from the front section into the rear section.

However, embodiments in which the exhaust line has two exhaust lines throughout are conceivable as well. The "rear" exhaust lines have a continuous design in this case and can be connected especially directly to the corresponding internal combustion engine in an exhaust gas-carrying manner.

In preferred embodiments, the exhaust device or the exhaust line has a component, which couples the rear exhaust lines with one another in a sound-transmitting manner. The component is consequently able, in particular, to transmit the sound or the vibrations, especially the airborne sound or the exhaust sound, of the rear exhaust lines to the respective other, rear exhaust line. Mixing and/or treatment and/or manipulation of the exhaust gas may also take place now by means of the component. The component is consequently especially the X-pipe as well as the Y-pipe or a mixing chamber or an exhaust gas treatment device for the exhaust gas. Embodiments in which the exhaust device has two or more such components or a combination thereof are conceivable as well.

The exhaust device advantageously has at least one muffler, which is used especially to manipulate the sound of the exhaust gas flowing in the muffler. The muffler is preferably arranged between the rear exhaust gas pipes and the at least one front exhaust gas pipe. In other words, the exhaust line has the two rear exhaust pipes downstream of the muffler and the at least one front exhaust pipe upstream of the muffler. The muffler is correspondingly such a component of the exhaust device that brings about the sound-transmitting coupling of the rear exhaust pipes. The exhaust gas generated by the internal combustion engine consequently enters the rear exhaust pipes through the at least one front exhaust pipe and via the at least one muffler, and uniform splitting of the exhaust gas takes, as a rule, place in the muffler.

The respective rear exhaust pipe has at least one such actuator, which acts especially as an electromagnetic sound generator and may be form a loudspeaker together with a membrane. The respective actuator is, moreover, connected to the rear exhaust pipe belonging to it in a sound-transmitting manner, so that an acoustic signal generated by the actuator can be transmitted to the corresponding rear exhaust pipe or to the exhaust gas. It is consequently an airborne sound-transmitting or fluidic connection between the actuator and the corresponding rear exhaust pipe. Due to the superposition of the acoustic signals generated by the corresponding actuator to the sound waves of the exhaust gas flowing in the rear exhaust pipe or to the exhaust gas sound waves, corresponding acoustic noises can thus be generated. In addition, the sound waves emitted by the respective rear exhaust pipe are superposed to one another outside the exhaust device, i.e., especially in the remote area, to generate a noise that is perceptible by a person located on the outside. An object of the present invention is to manipulate especially these noises perceptible from the outside.

The control device may have one or more control units. It is possible in this connection to control the respective actuator with a separate control unit. Two or more actuators may also be controlled by the same control unit. The respective control may be arranged, moreover, outside the corresponding actuator, especially in a control device housing of the control device or in an actuator housing, especially in a loudspeaker housing. The respective actuator advantageously has a signal connection to the control device or to the corresponding control unit. The respective control units are preferably coupled with one another, so that synchronized actuation of the respective control units or actuators can take place.

At least one time lag device, which is arranged in a connection path between at least one of the actuators and the control device, is provided in a preferred embodiment. The time lag device serves the purpose of delaying the signal sent by the control device to the corresponding actuator. Consequently, the arrangement of the time lag device in the connection path causes the acoustic signal generated by this actuator to the sent with a time delay compared to the acoustic signal of another actuator, which is actuated with the same control signal by the control device. Thus, these actuators generate different acoustic signals, and preset or desired or undesired noises can be amplified or suppressed by a judicious selection of the time delay device. A capacitor or a capacitor circuit or a capacitor-like circuit shall be mentioned here, in particular, as an example of such a time lag device. The time lag device may be arranged at any point in the connection path. This means that the time lag device may be arranged in/at the actuator, in the control device or between them. It is apparent that a plurality of such time lag devices, which have the same design or different designs, may be arranged in the connection path. It is also conceivable to arrange such time lag devices in a plurality of connection paths, in which case the respective time lag devices may be designed or equipped in the same manner or differently.

The control device can preferably change the control signal sent to the respective actuators as a function of preset parameters or adapt them to those parameters. Such parameters may be, for example, state variables of the internal combustion engine, e.g., an engine speed and/or a load of the internal combustion engine as well as thermodynamic parameters of the internal combustion engine, for example, the temperature. The particular acoustic signal may also depend on acoustic conditions of the corresponding internal combustion engine or of the exhaust device. Especially microphones, which are arranged at suitable points, for example, at or in the vicinity of the internal combustion engine or of the exhaust device, may be provided for this. These microphones advantageously have a connection to the control device. In addition, the control signals emitted at one or more actuators may depend on the acoustic signal from another actuator or from a plurality of other actuators. Polling of the particular actuator can correspondingly also take place via said connection path or an additional connection, or a sound sensor, e.g., a microphone, can be associated with the corresponding actuators. If a plurality of control units are provided, at least two of these are preferably coupled with one another, so that synchronized actuation of the respective control units or actuators can take place.

The transmission of the acoustic signal generated by the particular actuator to the corresponding rear exhaust pipe preferably takes place via a coupling point of the corresponding rear exhaust pipe. The coupling point may be especially the connection point between the exhaust pipe and a sound line connected fluidically to the corresponding actuator. The use of such a sound line has the advantage that thermal protection or reduced thermal load of the actuator from the hot and corrosive exhaust gases is given by the distance created by means of the sound line between the actuator and the corresponding rear exhaust pipe. In addition, a volume is present as a result, which can be used to generate the acoustic signal of the corresponding actuator.

By means of a different arrangement of the coupling points of the respective rear exhaust pipe, different design of these exhaust pipes can be achieved. According to a preferred embodiment, the exhaust line is designed such that the distance between the coupling point of one rear exhaust pipe and the outlet of this rear exhaust pipe along this rear exhaust pipe is greater than the distance between the coupling point of the other rear exhaust pipe and the outlet of this rear exhaust pipe along this rear exhaust pipe. The outlet of the respective rear exhaust pipe is now especially the point at which the exhaust gas is discharged from the corresponding rear exhaust pipe. The outlet is consequently arranged downstream of the coupling point and may correspond to a tail pipe of the exhaust device. As a result, the respective exhaust pipes emit sound waves that are offset in time, so that acoustic effects or noises, which cannot be generated with identical emitted sound waves, can be generated in the remote area. Embodiments in which these distances differ by at least 10 cm are preferred. This typically leads to beating (alternating constructive and destructive interference causes the sound to be alternatively soft and loud) of the emitted sound waves, whereby said acoustic effects can be generated.

Embodiments in which the distance between the coupling point of one rear exhaust pipe and the component arranged upstream, especially the muffler or the X-pipe or the Y-pipe, along this rear exhaust pipe is greater than the distance between the coupling point of the other rear exhaust pipe and the component arranged upstream along this rear exhaust pipe is preferred especially in exhaust devices having the sound-transmitting component. The component arranged upstream of the coupling point of one rear exhaust pipe does, as a rule, correspond to the component that is arranged upstream of the coupling point of the other rear exhaust pipe. This means that the two rear exhaust pipes open on the upstream side into the same component or are coupled with the same component. As an alternative, these distances between the respective coupling point and the first impedance jump arranged upstream may be given, and this impedance jump is, as a rule, the component. This is the discovery that a different feedback to the component is achieved by the different distance of the respective coupling point from the component. This feedback or transfer function of the component to the respective coupling point and hence to the respective actuator leads to different superpositions of this feedback with the acoustic signal generated by the respective actuator. As a result, the frequencies or amplitudes of the sound waves emitted by the respective rear exhaust pipe may differ, so that acoustic effects and noises, which cannot be with identically emitted sound waves of the respective rear exhaust pipe or can be emitted with difficulty only, are generated by the superposition of these emitted sound waves, especially in the remote area.

The sound waves emitted by the respective rear exhaust pipes preferably differ by a slight frequency shift. This means that a frequency difference between the two emitted sound waves preferably equals only a few Hz. The discovery that so-called beating occurs in case of the superposition of such waves is utilized here. By utilizing this beating effect, it is possible, for example, to generate asymmetrical noises, which are clearly audible in the low frequency range. In other words, a noise or acoustic effect which is not emitted directly by either the actuators or the respective rear exhaust pipe can be generated in the remote area. Such low-frequency and especially asymmetrical noises can generate, for example, a noise typical of an 8-cylinder internal combustion engine, even though the exhaust device is connected to or arranged at another internal combustion engine with fewer or more than 8 cylinders.

As an alternative or in addition, the generation of different emitted sound waves of the respective rear exhaust pipe may take place, as was mentioned already, by the different actuation of the respective actuators, and the controlling, i.e., the sending of a corresponding control signal to the respective actuator takes place by means of the control device. It will hereinafter be assumed for simplicity's sake that the respective rear exhaust pipe has only a single corresponding actuator. However, it is apparent that the following description can be analogously expanded to embodiments in which the rear exhaust pipes have a plurality of respective actuators.

In a preferred embodiment, the control device actuates the actuators such that the acoustic signal generated by the actuator of one rear exhaust pipe has a frequency shift compared to the acoustic signal generated by the actuator of the other rear exhaust pipe. This means that the acoustic signals of the respective actuators have different wavelengths. This frequency difference preferably corresponds to 5 Hz. In particular, one actuator generates an acoustic signal with a frequency of 100 Hz, while the acoustic signal of the other actuator has a frequency of 105 Hz. It is possible as a result especially to generate or utilize said beating effect and to generate especially a low-frequency noise.

As an alternative or in addition, the acoustic signals generated by the different actuators have different amplitudes. This means that the control device actuates the actuators such that the acoustic signal generated by the actuator of one rear exhaust pipe has an amplitude different from that of the acoustic signal generated by the actuator of the other rear exhaust pipe, and these amplitudes preferably differ by more than 2 dB.

In another variant, the acoustic signals generated by the different actuators have a phase shift. The phase shift may be regulated such that it is variable or it may be constant. This means that the acoustic signals generated by the two actuators are identical, but have a frequency-dependent time shift. Embodiments in which the phase shift is at least 10° are preferred.

Another possibility is given by the fact that the acoustic signals generated by the different actuators have a time shift. This means that the control device actuates the actuators such that the acoustic signal generated by the actuator of one rear exhaust pipe has a time shift compared to the acoustic signal generated by the actuator of the other rear exhaust pipe. The time shift between the two acoustic signals is especially constant and greater than 0.05 msec. The time shift between the acoustic signals generated by the respective actuator leads to different phase shifts of the acoustic signals depending on the frequency of these acoustic signals. As was mentioned already, a similar effect can be achieved by arranging the time lag device in the corresponding connection path.

Another possibility is that the acoustic signals generated by the actuators of the corresponding rear exhaust pipe have different frequency compositions. This can be achieved, for example, by the control device actuating the actuators such that the acoustic signal generated by the actuator of one rear exhaust pipe has a different frequency composition than the acoustic signal generated by the actuator of the other rear exhaust pipe. This can be achieved especially by the superposition of different frequency components.

It is apparent that the frequency shift and/or the different amplitudes and/or the phase shift and/or the time shift and/or the frequency composition of the respective acoustic signal can also apply to the control signal sent to these actuators, if the actuators have the same design.

It shall, furthermore, be noted that the properties of the rear exhaust pipes and of the corresponding actuators described in this case can analogously also be extrapolated to the at least one front exhaust pipe. Furthermore, the exhaust line or the exhaust device may have three or more rear exhaust pipes, in which case at least two of the rear exhaust pipes comprise such a corresponding actuator and are designed or equipped according to the present invention such that they can simultaneously emit different sound waves, without going beyond the scope of the present invention.

In an advantageous variant of the solution according to the present invention, such an exhaust device is part of a motor vehicle. The motor vehicle comprises, furthermore, an internal combustion engine, which is fluidically connected to the at least one front exhaust pipe of the exhaust device. The fluidic connection between the internal combustion engine and the at least one front exhaust pipe is preferably guaranteed by means or via an exhaust manifold, wherein said exhaust manifold may be part of the exhaust device. Preferred are in this connection embodiments in which the exhaust device has two such front exhaust pipes, which are associated with different areas of the internal combustion engine. This means that the internal combustion engine may be designed or equipped such that the exhaust gas generated by different cylinders or different groups of cylinders is removed via one front exhaust pipe or via the other front exhaust pipe.

In a preferred embodiment, the motor vehicle has an exhaust line, which supplies the internal combustion engine with air or feeds air to the internal combustion engine. In addition, at least one acoustic intake actuator is provided, which is connected to the intake line in a sound-transmitting manner. The at least one intake actuator is preferably controlled in this case by the control device, so that the acoustic signal generated by the intake actuator can be controlled by the control device. The control device can thus coordinate the acoustic signals generated by the actuators of the rear exhaust pipes and the acoustic signal generated by the intake actuator with one another and correspondingly make possible a greater variety of audible noises. The control device is advantageously designed or equipped such that it can coordinate the control signals to the different actuators or intake actuators with one another or match them with one another. Preset parameters or determined parameters and state variables may also play a role here. For example, one or more microphones or sound sensors may be provided, which measure the noises at predetermined points, especially in the vicinity of the internal combustion engine or in a passenger compartment of the motor vehicle. In addition, the temperature, the engine speed as well as the load of the internal combustion engine may affect the actuators actuated by the control device or the corresponding control signals. Especially characteristics or characteristic diagrams may be provided for this, which are associated with the operating points of the internal combustion engine or of the vehicle. It is thus possible to adjust noise that is generated by the motor vehicle and is audible towards the outside or in the vehicle, especially in the passenger compartment to certain preset driving situations or operating points.

As an alternative or in addition, the motor vehicle may also have an acoustic inner actuator, which is arranged in the interior of the motor vehicle, especially in the passenger compartment of the motor vehicle. It is possible by means of this inner actuator to manipulate especially the noises audible to a driver of the motor vehicle. For example, "sporty" and "dynamic" driving situations can thus be intensified or accompanied with corresponding noises.

It shall be pointed out that the different design of the rear exhaust pipes or of the exhaust device in this area and the arrangements of the respective coupling points also depend, in particular, on the geometric conditions of the corresponding motor vehicle and the particular acoustic requirements. This also applies to the actuation of the actuators, and this possibility makes it possible to obtain a greater variety of acoustic effects that can be generated due to a less expensive implementation and a greater variability.

It is apparent that the above-mentioned features, which will also be explained below, can be used not only in the particular combination indicated, but in other combinations or alone as well, without going beyond the scope of the present invention.

Preferred exemplary embodiments of the present invention are shown in the drawings and will be explained in more detail in the following description, where identical reference numbers designate identical or similar or functionally identical components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
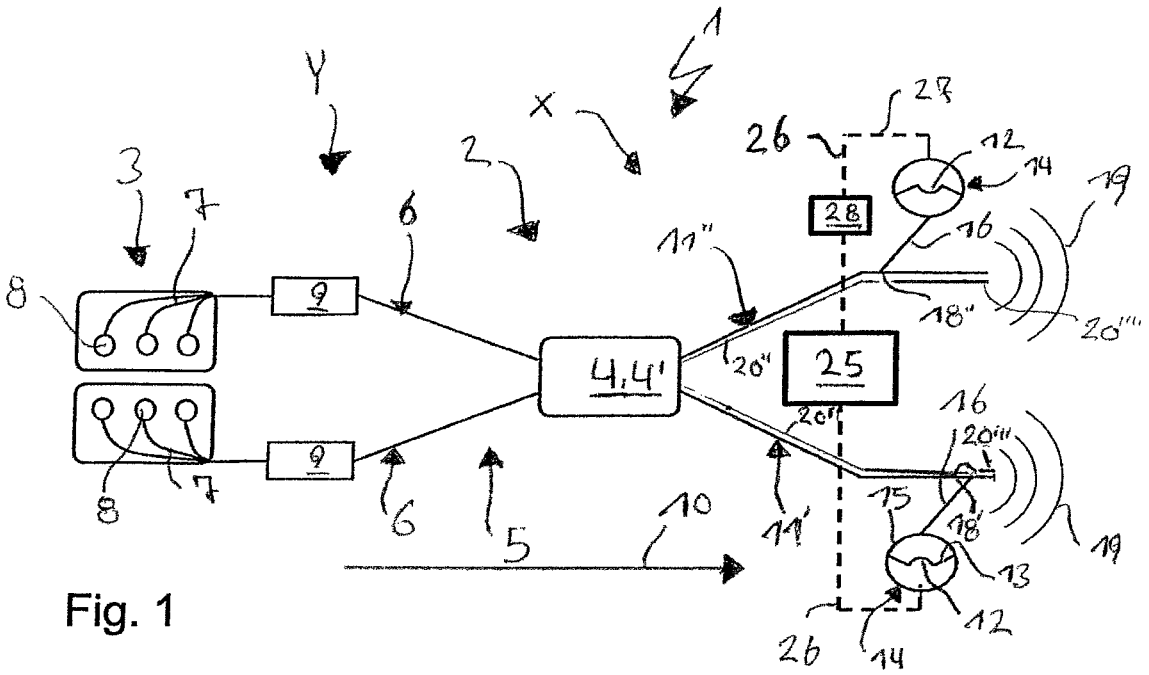
FIG. 1 is a highly simplified circuit diagram-like view of a motor vehicle according to one embodiment of the invention.
Figure 2:
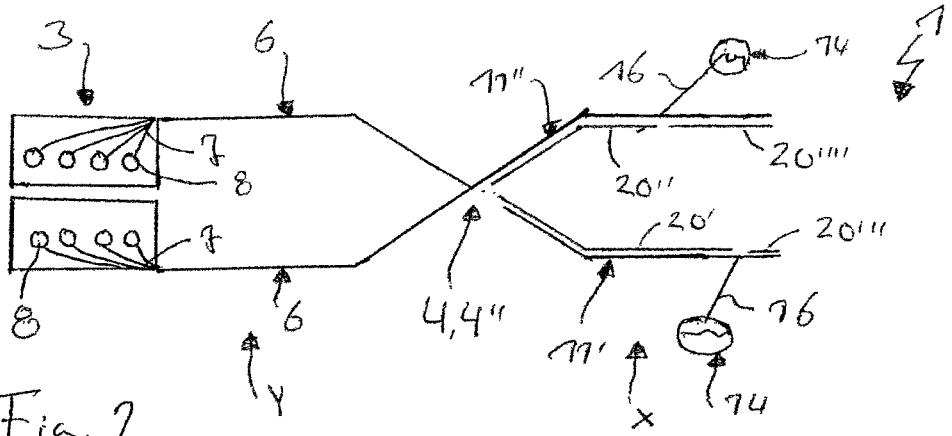
FIG. 2 is a highly simplified circuit diagram-like view of a motor vehicle according to another embodiment of the invention.
Figure 3:
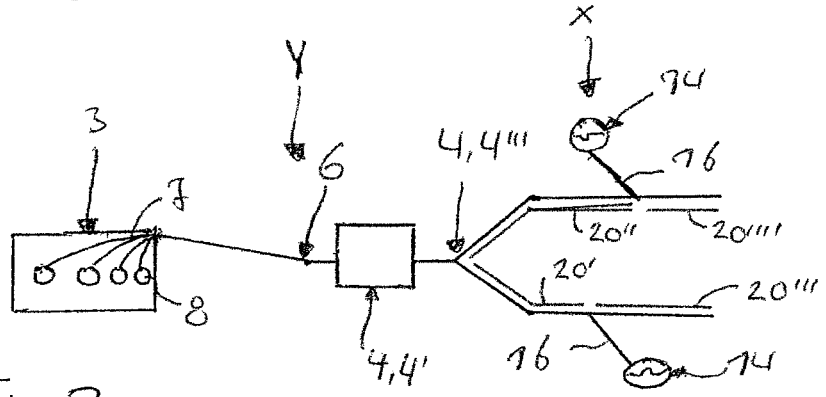
FIG. 3 is a highly simplified circuit diagram-like view of a motor vehicle according to another embodiment of the invention.

Referring to the drawings in particular, corresponding to FIG. 1 through FIG. 3, a motor vehicle 1 has an exhaust device 2, which is used to remove an exhaust gas generated by an internal combustion engine 3 of the motor vehicle 1. The designations upstream and downstream are related below to the direction of flow of the exhaust gas given in the exhaust device 3, which is indicated by an arrow 10. This analogously also applies to the terms "rear" and "front," wherein "rear" is located farther away from the internal combustion engine 3 in the direction of flow 10. The exhaust device 2 is of a two-stage design at least in a rear section X and correspondingly has two exhaust gas-carrying exhaust pipes 11 in the rear section, which are simply designated in a simplified manner as rear exhaust pipes 11 below. In the examples shown in FIGS. 1 through 3, the rear exhaust pipes 11 are coupled with one another in a sound-transmitting manner by means of at least one component 4. Component 4 in FIG. 1 is designed in this case as a muffler 4' or as any desired mixing space 4' and as an X-pipe 4" in FIG. 2. The embodiment shown in FIG. 3 has two such components 4, wherein one of the components 4 is designed as a Y-pipe 4''', while the other component 4 is designed as a muffler 4' and is arranged upstream of the Y-pipe 4'''.

Exhaust line 5 has at least one front exhaust pipe 6 upstream of component 4, the examples shown in FIG. 1 and FIG. 2 showing two such front exhaust pipes 6, while the embodiment shown in FIG. 3 has such a front exhaust pipe 6. Component 4 correspondingly splits in the examples being shown the exhaust line into the rear section X and the front section Y. The respective exhaust pipe 6 is connected to the internal combustion engine 3 in an exhaust gas-carrying manner. This exhaust gas-carrying connection is brought about via an exhaust manifold 7 each. The respective exhaust manifold 7 collects and bundles the exhaust gas generated by a plurality of cylinders 8 of the internal combustion engine 3 and sends these exhaust gases to the respective corresponding front exhaust pipe 6. The respective component 4 guarantees, moreover, a uniform distribution of the exhaust gas flowing into rear exhaust pipes 11 from the at least one front exhaust line 6. The exhaust line 5 shown in FIG. 1 has, moreover, two exhaust gas-treating units 9, for example, particle filters 9 and/or catalytic converters 9, which are arranged each upstream of the muffler 4' in one of the front exhaust pipes 6.

Figure 4:
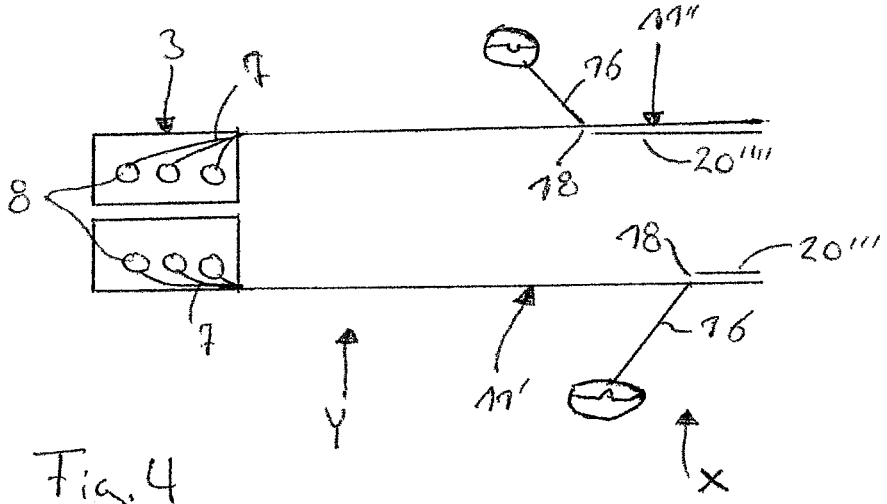
FIG. 4 is a highly simplified circuit diagram-like view of a motor vehicle according to another embodiment of the invention.

The example shown in FIG. 4 has, contrary to the embodiments shown in FIG. 1 through FIG. 3, no sound-transmitting component 4. Exhaust line 5 correspondingly has two continuous exhaust pipes 11, which will hereinafter be called "rear" exhaust pipes 22 for simplicity's sake, even though they extend up into the front section Y.

All exhaust devices 2 shown are consequently designed as a so-called double-flow exhaust device 2 and consequently have two rear exhaust pipes 11 in the rear area X, which remove the exhaust gas to the outside. The respective rear exhaust pipe 11 comprises an acoustic actuator 12, which may be designed or outfitted, for example, as an electromagnetic actuator 12. Together with a membrane 13, the respective actuator 12 forms a loudspeaker 14, which is arranged in a loudspeaker housing 15. The respective actuator 12 or loudspeaker 14 is connected to the corresponding rear exhaust pipe 11 in a sound-transmitting, especially airborne noise-transmitting manner. A sound line 16, which fluidically connects the respective actuator 12 or loudspeaker 14 to the corresponding rear exhaust pipe 11, is provided for this.

The respective actuators may, in principle, also be arranged in the front section Y of the exhaust line 5 in the example shown in FIG. 4.

Figure 5:
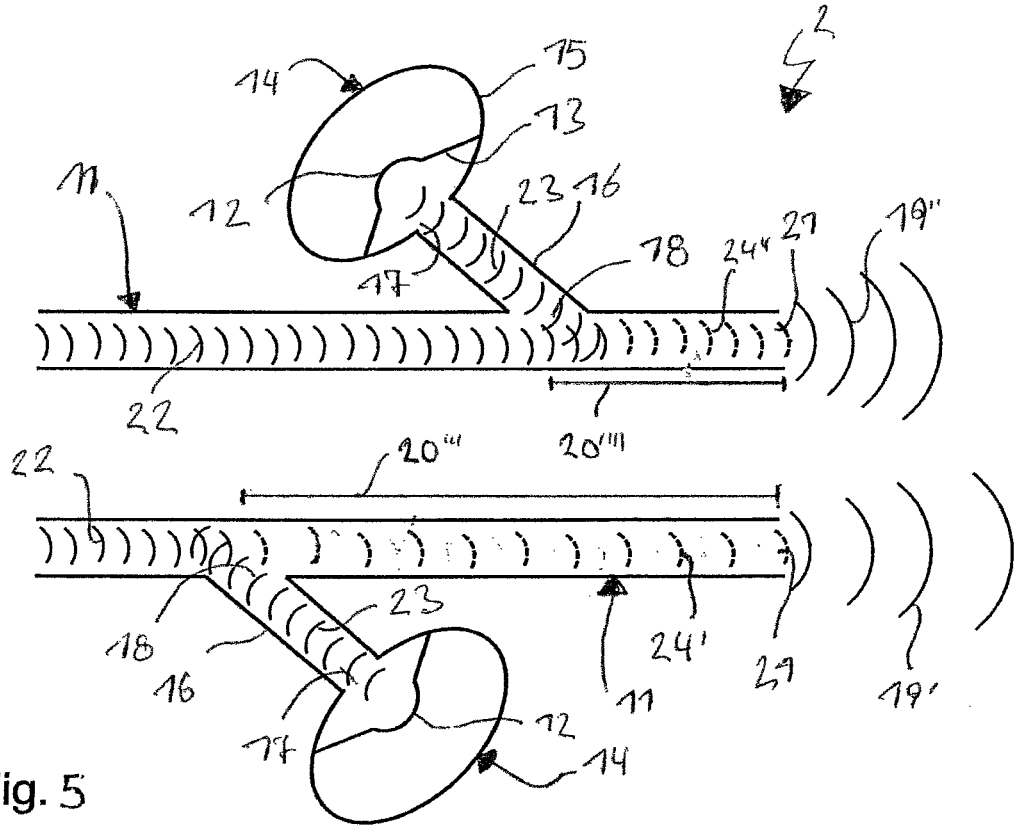
FIG. 5 is a schematic view of an exhaust device according to the invention.

The fluidic connection between actuator 12 and the corresponding rear exhaust pipe 11 by means of sound pipe 16 is embodied, as is shown in FIG. 5, by the loudspeaker housing 15 having an opening 17, while the corresponding rear exhaust pipe 11 has another opening or a coupling point 18, with the respective sound line 16 fluidically connecting opening 17 of the loudspeaker housing 15 to the corresponding coupling point 18 of the rear exhaust pipe 11.

In order for the respective rear exhaust pipes 11 to emit a different sound wave 19, exhaust line 5 has a different design, especially in the area of the rear exhaust pipes 11. This means that one rear exhaust pipe 11 has a different design compared to the other rear exhaust pipe 11.

This is embodied in the examples shown in FIG. 1 through FIG. 4 by sound lines 16 extending in opposite directions as well as coupling points 18 positioned at different points. The rear exhaust pipes 11 thus have a symmetrical design relative to one another. The asymmetrical design of the rear exhaust pipes 11 as well as the different arrangement of the coupling points 18 cause in the examples shown in FIG. 1 through FIG. 3 especially the coupling point 18' of one rear exhaust pipe 11' to have a greater distance 20' along this rear exhaust pipe 11' from the component 4 arranged upstream compared to the distance 20" between the coupling point 18" of the other rear exhaust pipe 11" along this rear exhaust pipe 11". In addition, coupling point 18" of the embodiments of one rear exhaust pipe 11' shown in FIG. 1 through FIG. 4 along this rear exhaust pipe 11' has a shorter distance 20''' from an outlet 21, especially the tail pipe 21, of this rear exhaust pipe 11', which is shorter than the distance 20''' between coupling point 18" of the other rear exhaust pipe 11' and outlet 21 of this rear exhaust pipe 11. Which of the coupling points 18 of one rear exhaust pipe 11 has a greater distance 20 from the muffler 4 or the corresponding outlet 21 is irrelevant here.

Due to the different arrangement of the coupling points 18 or due to the asymmetric design of the rear exhaust pipes 11 and the sound lines 16 thereof, it is possible to manipulate exhaust sound waves 22 originating from the internal combustion engine 3 such that the sound waves 19 emitted by the one rear exhaust pipe 11 are different from the sound waves 19 emitted by the other rear exhaust pipe 11. This means especially that the sound waves 19 emitted by one rear exhaust pipe 11 may have a different frequency and/or amplitude than the sound waves 19 emitted by the other rear exhaust pipe 11. This happens, as is shown as an example in FIG. 5, due to the fact that acoustic signals 23 generated by the respective actuator 12 or loudspeaker 14 interact with the exhaust gas sound waves 22 and are superposed to these in a different manner. As is shown schematically in FIG. 5, this is due, on the one hand, to the fact that the sound lines 18 and the actuators 12 or loudspeakers 14 are arranged opposite each other or asymmetrically. Different superpositions or interferences will correspondingly develop when the acoustic signals 23 of the actuators 12 meet the exhaust gas sound waves 22 in the area of the coupling points 18. This causes the resulting sound waves 24' of one exhaust pipe 11 to have a different characteristic, for example, a different amplitude or frequency than the resulting sound waves 24" of the other rear exhaust pipe 11. Consequently, the sound waves 19' emitted by the outlet 21 of one rear exhaust pipe 11 are characterized differently than the sound waves 19" emitted by the outlet 21 of the other rear exhaust pipe 11. In particular, these emitted sound waves 19, 19" may have different frequencies and/or amplitudes and/or frequency compositions as well as a phase shift. The noises generated in the remote area, i.e., outside the exhaust device 2, based on the superposition of the emitted waves 19 can the correspondingly manipulated. It is thus possible to suppress undesired noises and to generate desired noises, which correspond, for example, to a powerful internal combustion engine or a sporty driving style.

The different distances 20 of the coupling points 18 with the respective rear exhaust pipes 11 additionally lead to a different feedback between the coupling point 18 and component 4 or the corresponding outlet 21. These different feedbacks likewise affect the resulting sound waves 24 and consequently the emitted sound waves 19 and may lead, for example, the frequency superpositions.

An alternative or additional possibility of generating different emitted sound waves 19 is shown in FIG. 1. A control means or control device 25 is provided according to the invention. The control means 25 is for actuating the actuators 12 of the rear exhaust pipes 11. Via a connection 26 with the respective actuator 12, control device 25 sends a control signal to the actuators 12, which control signal is converted by the actuators into the corresponding acoustic signals (sound) 23. In addition, a time lag device 28, especially a capacitor 28, is arranged along a connection path 27 between control device 25 and one of the actuators 12. The time lag device 28 delays the control signal sent to the corresponding actuator 12, so that in case of identical control signals sent by control device 25, the actuators 12 generate different acoustic signals 23 with a corresponding time lag, which have a phase shift depending on the frequency of the acoustic signals 23.

As an alternative or in addition, the control device can actuate the respective actuator 12 such that the acoustic signal 23 generated by one rear exhaust pipe 11 is different from the acoustic signal 23 of the actuator 12 of the other rear exhaust pipe. The acoustic signals 23 may differ, in particular, by a time shift, phase shift as well as different amplitudes and/or frequencies and/or frequency compositions.

It is also conceivable to arrange the control device 25 in the loudspeaker housing 15 of one of the loudspeakers 14 in order to protect control device 25 from thermal effects of the exhaust gas and to save space. It is also conceivable to equip control device 25 with a plurality of control units and to arrange the respective control device in such a corresponding loudspeaker housing 15. Control device 25 or the respective control units are especially designed or equipped such that they actuate the corresponding actuators 12 as a function of one another or as a function of external parameters and/or preset parameters.

Figure 6:
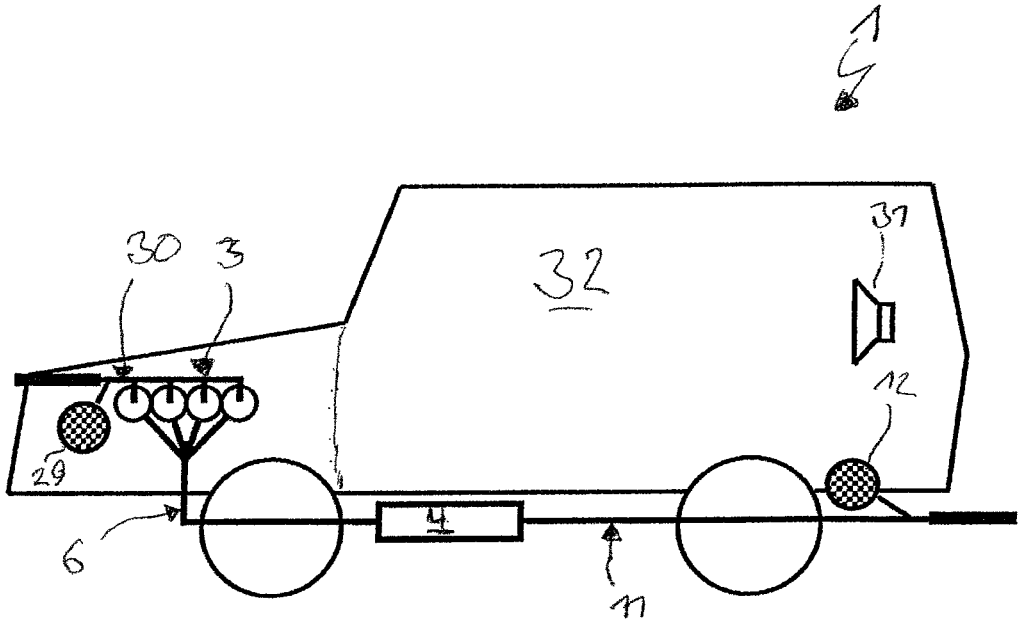
FIG. 6 is a schematic view of a motor vehicle according to the invention.

As is shown in FIG. 6, the actuators 12 of the rear exhaust pipes 11 can cooperate with actuators 29 of an intake line 30 of the motor vehicle 1, which is used to feed air to the internal combustion engine 3. The actuators 29 or intake actuators 29 associated with the intake line 30 generate acoustic signals, which interact with air waves of the intake line 30. In addition, the motor vehicle 1 has an inner actuator 31, for example, an inner loudspeaker 31, which is arranged in the interior of the motor vehicle 1, especially in a passenger compartment 32 of the motor vehicle 1. Due to the interaction of the actuators 12 of the rear exhaust pipes 11 with the intake actuator 29 as well as with the inner actuator 38, increased variety of noises audible to occupants of the motor vehicle 1 or from the outside can be generated.

While specific embodiments of the invention have been shown and described in detail to illustrate the application of the principles of the invention, it will be understood that the invention may be embodied otherwise without departing from such principles.

What is claimed is:

1. An exhaust device for an internal combustion engine with an exhaust line which has a double-flow section at least in a rear section, the exhaust device comprising:

a first exhaust pipe in the double-flow section;

a second exhaust pipe in the double-flow section;

a first acoustic actuator connected to the first exhaust pipe in a sound-transmitting manner; and a second acoustic actuator connected to the second exhaust pipe in a sound-transmitting manner, wherein the exhaust pipes have different structural designs, the first exhaust pipe having a coupling point at which sound transmission of the first actuator to the first exhaust pipe takes place, the second exhaust pipe having a coupling point at which sound transmission of the second actuator to the second exhaust pipe takes place, wherein a distance between the coupling point of the first exhaust pipe and an outlet of the first exhaust pipe along the first exhaust pipe is at least ten centimeters greater than a distance between the coupling point of the second exhaust pipe and an outlet of the second exhaust pipe along the second exhaust pipe.

2. An exhaust device in accordance with claim 1, further comprising an electronic control unit individually actuating the first acoustic actuator and individually actuating the second acoustic actuator.

3. An exhaust device in accordance with claim 2, further comprising a time lag device, wherein:

the electronic control unit is connected to the first actuator via a first connection path;

the electronic control unit is connected to the second actuator via a second connection path; and the time lag device is provided in at least one of the first connection path and the second connection path between the electronic control unit and at least one of the first actuator and the second actuator.

4. An exhaust device in accordance with claim 1, wherein the exhaust line further comprises a component that couples the first exhaust pipe and the second exhaust pipe with one another in a sound-transmitting manner.

5. An exhaust device in accordance with claim 4, wherein a distance between the coupling point of one of the first exhaust pipe and the second exhaust pipe exhaust pipe and the component along the rear section is greater than the distance between the coupling point of the other of the first exhaust pipe and the second exhaust pipe and the component along the rear section.

6. An exhaust device in accordance with claim 4, wherein the component is a muffler or an X-pipe or a Y-pipe or a combination of a muffler and an X-pipe or a muffler and a Y-pipe.

7. A process for controlling actuators of an exhaust device for an internal combustion engine with an exhaust line which has a double-flow section at least in a rear section, the process comprising the steps of:

providing an exhaust device comprising a first exhaust pipe in the double-flow section, a second exhaust pipe in the double-flow section, a first acoustic actuator connected to the first exhaust pipe in a sound-transmitting manner and a second acoustic actuator connected to the second exhaust pipe in a sound-transmitting manner, wherein the first exhaust pipe and the second exhaust pipe have different designs, said first exhaust pipe having a coupling point at which sound transmission of the first acoustic actuator to the first exhaust pipe takes place, said second exhaust pipe having a coupling point at which sound transmission of the second acoustic actuator to the second exhaust pipe takes place, wherein a distance between the coupling point of the first exhaust pipe and an outlet of the first exhaust pipe along the first exhaust pipe is greater than a distance between the coupling point of the second exhaust pipe and an outlet of the second exhaust pipe along the second exhaust pipe.

8. A process in accordance with claim 7, further comprising:

connecting an electronic control unit to the actuators, wherein the electronic control unit actuates the actuators such that the acoustic signal generated by the first actuator has a frequency shift compared to the acoustic signal generated by the second actuator.

9. A process in accordance with claim 8, wherein said frequency shift equals 5 Hz.

10. A process in accordance with claim 7, further comprising:

connecting an electronic control unit to the actuators, wherein the electronic control unit actuates the actuators such that the acoustic signal generated by the first actuator has a phase shift compared to the acoustic signal generated by the second actuator, said first actuator and said second actuator being actuated individually via the electronic control unit.

11. A process in accordance with claim 7, further comprising:

connecting an electronic control unit to the actuators, wherein the electronic control unit actuates the actuators such that the acoustic signal generated by the first actuator has a time shift compared to the acoustic signal generated by the second actuator, said exhaust line further comprising a component that couples the first exhaust pipe and the second exhaust pipe with one another in a sound-transmitting manner, wherein a distance between the coupling point of one of the first exhaust pipe and the second exhaust pipe exhaust pipe and the component along the rear section is greater than the distance between the coupling point of the other of the first exhaust pipe and the second exhaust pipe and the component along the rear section.

12. A process in accordance with claim 7, further comprising:

connecting an electronic control unit to the actuators, wherein the electronic control unit actuates the actuators such that the acoustic signal generated by the first actuator has a different frequency composition compared to the acoustic signal generated by the second actuator.

13. A motor vehicle comprising:

an internal combustion engine; and an exhaust line connected to the internal combustion engine, the exhaust line comprising a double-flow section at least in a rear section and an exhaust device comprising:

a first exhaust pipe in the double-flow section;

a second exhaust pipe in the double-flow section;

a first acoustic actuator connected to the first exhaust pipe in a sound-transmitting manner; and a second acoustic actuator connected to the second exhaust pipe in a sound-transmitting manner, wherein the first exhaust pipe and the second exhaust pipe have different designs, said first exhaust pipe having a coupling point at which sound transmission of the first acoustic actuator to the first exhaust pipe takes place, said second exhaust pipe having a coupling point at which sound transmission of the second acoustic actuator to the second exhaust pipe takes place, wherein a distance between the coupling point of the first exhaust pipe and an outlet of the first exhaust pipe along the first exhaust pipe is greater than a distance between the coupling point of the second exhaust pipe and an outlet of the second exhaust pipe along the second exhaust pipe.

14. A motor vehicle in accordance with claim 13, further comprising an electronic control unit individually actuating the first acoustic actuator and the second acoustic actuator.

15. A motor vehicle in accordance with claim 14, wherein the electronic control unit actuates the actuators such that at least one of:

the acoustic signal generated by the first actuator has a frequency shift compared to the acoustic signal generated by the second actuator;

the acoustic signal generated by the first actuator has an amplitude different from the acoustic signal generated by the second actuator;

the acoustic signal generated by the first actuator has a phase shift compared to the acoustic signal generated by the second actuator;

the acoustic signal generated by the first actuator has a time shift compared to the acoustic signal generated by the second actuator; and the acoustic signal generated by the first actuator has a different frequency composition compared to the acoustic signal generated by the second actuator.

16. A motor vehicle in accordance with claim 14, further comprising:

an acoustic intake actuator; and an intake line for supplying the internal combustion engine with air, the intake line being connected to said acoustic intake actuator, wherein the acoustic intake actuator is controlled by the electronic control unit.

17. A motor vehicle in accordance with claim 14, further comprising:

an acoustic inner actuator arranged in an interior of the motor vehicle, wherein the acoustic inner actuator is controlled by the electronic control unit, said exhaust line further comprising a component that couples the first exhaust pipe and the second exhaust pipe with one another in a sound-transmitting manner, wherein a distance between the coupling point of one of the first exhaust pipe and the second exhaust pipe exhaust pipe and the component along the rear section is greater than the distance between the coupling point of the other of the first exhaust pipe and the second exhaust pipe and the component along the rear section.

18. An exhaust device for an internal combustion engine with an exhaust line which has a double-flow section at least in a rear section, the exhaust device comprising:

a first exhaust pipe in the double-flow section;

a second exhaust pipe in the double-flow section;

a first acoustic actuator connected to the first exhaust pipe in a sound-transmitting manner; and a second acoustic actuator connected to the second exhaust pipe in a sound-transmitting manner, wherein the exhaust pipes have different structural designs, the first exhaust pipe having a coupling point at which sound transmission of the first actuator to the first exhaust pipe takes place, the second exhaust pipe having a coupling point at which sound transmission of the second actuator to the second exhaust pipe takes place, the exhaust line further comprising a component that couples the first exhaust pipe and the second exhaust pipe with one another in a sound-transmitting manner, wherein a distance between the coupling point of one of the first exhaust pipe and the second exhaust pipe exhaust pipe and the component along the rear section is greater than the distance between the coupling point of the other of the first exhaust pipe and the second exhaust pipe and the component along the rear section.

19. An exhaust device for an internal combustion engine with an exhaust line which has a double-flow section at least in a rear section, the exhaust device comprising:

a first exhaust pipe in the double-flow section;

a second exhaust pipe in the double-flow section;

a first acoustic actuator connected to the first exhaust pipe in a sound-transmitting manner; and a second acoustic actuator connected to the second exhaust pipe in a sound-transmitting manner, wherein the exhaust pipes have different structural designs, the first exhaust pipe having a coupling point at which sound transmission of the first actuator to the first exhaust pipe takes place, the second exhaust pipe having a coupling point at which sound transmission of the second actuator to the second exhaust pipe takes place, the exhaust line further comprising a component that couples the first exhaust pipe and the second exhaust pipe with one another in a sound-transmitting manner, wherein a distance between the coupling point of the first exhaust pipe and an outlet of the first exhaust pipe along the first exhaust pipe is greater than a distance between the coupling point of the second exhaust pipe and an outlet of the second exhaust pipe along the second exhaust pipe.

20. A process for controlling actuators of an exhaust device for an internal combustion engine with an exhaust line which has a double-flow section at least in a rear section, the process comprising the steps of:

providing an exhaust device comprising a first exhaust pipe in the double-flow section, a second exhaust pipe in the double-flow section, a first acoustic actuator connected to the first exhaust pipe in a sound-transmitting manner and a second acoustic actuator connected to the second exhaust pipe in a sound-transmitting manner, wherein the first exhaust pipe and the second exhaust pipe have different designs, said first exhaust pipe having a coupling point at which sound transmission of the first actuator to the first exhaust pipe takes place, said second exhaust pipe having a coupling point at which sound transmission of the second actuator to the second exhaust pipe takes place, said exhaust line further comprising a component that couples the first exhaust pipe and the second exhaust pipe with one another in a sound-transmitting manner, wherein a distance between the coupling point of one of the first exhaust pipe and the second exhaust pipe exhaust pipe and the component along the rear section is greater than the distance between the coupling point of the other of the first exhaust pipe and the second exhaust pipe and the component along the rear section.

* * * * *